US005729278A

United States Patent [19]

Appel et al.

[11] Patent Number: 5,729,278

[45] Date of Patent: Mar. 17, 1998

[54] SIDEWINDER RASTER OUTPUT SCANNER

[75] Inventors: James J. Appel, Rochester; Edward C. Bock; David P. Wind, both of Webster, all of N.Y.

[73] Assignee: Xerox Corporation, Stamford, Conn.

[21] Appl. No.: 674,071

[22] Filed: Jul. 1, 1996

[51] Int. Cl.[6] ..... B41J 2/47

[52] U.S. Cl. ..... 347/259; 347/256

[58] Field of Search ..... 347/129, 137, 347/225, 230, 233, 241, 243, 242, 256, 257, 258, 259

[56] References Cited

U.S. PATENT DOCUMENTS

| | | | |
|---|---|---|---|
| 5,302,973 | 4/1994 | Costanza et al. | 347/233 |
| 5,351,070 | 9/1994 | Hinton et al. | 347/242 |
| 5,363,126 | 11/1994 | Andrews | 347/134 |
| 5,450,119 | 9/1995 | Hinton et al. | 347/242 |
| 5,512,949 | 4/1996 | Fisli et al. | 347/259 |
| 5,543,829 | 8/1996 | Fisli | 347/241 |
| 5,617,133 | 4/1997 | Fisli | 347/261 |

*Primary Examiner*—Adolf Berhane
*Attorney, Agent, or Firm*—John M. Kelly

[57] ABSTRACT

Compact raster scanner assemblies, and systems which use such assemblies, having a laser source generating laser light; a photoreceptor moving in a process direction; and a raster scanner raster sweeping the photoreceptor. The raster scanner includes a rotating polygon, an F-θ scan lens in the sweep plane, and a first folding mirror positioned along a first axis for reflecting laser light passing through the F-θ scan lens toward the photoreceptor. The first folding mirror being aligned along an axis which is at an angle with both the process direction and the resulting fast scan direction. The raster scanner assembly further including a second folding mirror for receiving laser light reflected by the first folding mirror and for directing that laser light toward the photoreceptor such that the laser light sweeps across the photoreceptor in a direction perpendicular to the process direction.

10 Claims, 3 Drawing Sheets

SIDEWINDER RASTER OUTPUT SCANNER

FIELD OF THE INVENTION

This invention relates to electrophotographic systems which use raster scanners.

BACKGROUND OF THE INVENTION

Electrophotographic marking is a well known method of copying or printing documents or other substrates. Electrophotographic marking is typically performed by exposing a light image of an original document onto a substantially uniformly charged photoreceptor. That light image discharges the photoreceptor so as to create an electrostatic latent image of the original on the photoreceptor's surface. Toner particles are then deposited onto the latent image to form a toner image. That toner image is then transferred from the photoreceptor, either directly or after an intermediate transfer step, onto a marking substrate such as a sheet of paper. The transferred toner powder image is then fused to the marking substrate using heat and/or pressure. The surface of the photoreceptor is then cleaned of residual developing material and recharged in preparation for the creation of another image.

While many types of light exposure systems have been developed, a commonly used system is the raster output scanner (ROS). A raster output scanner is comprised of a laser beam source, a modulator for modulating the laser beam (which, as in the case of a laser diode, may be the source itself) such that the laser beam contains image information, a rotating polygon having at least one reflective surface, input optics that collimate the laser beam, output optics which focus the laser beam into a spot on the photoreceptor and which corrects for various optical problems such as wobble, and, usually, one or more folding mirrors. The laser source, modulator, and input optics produce a collimated laser beam which is directed toward the polygon. As the polygon rotates the reflective surface(s) causes the laser beam to be swept along a scan plane. The swept laser beam passes through the output optics and is reflected by the mirror(s) so as to produce a sweeping spot on a charged photoreceptor. The sweeping spot in turn traces a scan line across the photoreceptor. Since the charged photoreceptor moves in a direction which is substantially perpendicular to the scan line, the sweeping spot raster scans the photoreceptor. By suitably modulating the laser beam a desired latent image can be produced on the photoreceptor.

To assist the understanding of the present invention several things should be further described and highlighted. First, raster output scanners are usually implemented such that the rotating polygon is part of motor polygon assembly. A motor polygon assembly includes not only the polygon, but also a drive motor, bearings, shafts, mounts, and, possibly, a speed control circuit for the motor. In practice, the motor polygon assembly is usually the largest component of the raster output scanner. Second, the output optics includes an F-θ scan lens which focuses the spot produced on the photoreceptor. Third, to assist in understanding the present invention the direction of motion of the spot on the photoreceptor is referred to as the fast scan direction while the direction of motion of the photoreceptor is referred to as the process direction. The fast scan direction and the process direction are substantially perpendicular.

While raster output scanner based electrophotographic marking machines are well known, implementing machines that fit into a small space or on a desk is difficult. One reason for this is that the optical cross-sectional area of the raster output scanner, that is, the area that must remain obstructionless so that the charged photoreceptor can be properly illuminated, limits how small the machine can be. Raster output scanner implementations which reduce the optical cross-sectional area are useful.

Prior art raster output scanner based electrophotographic marking machines often use mirrors to fold the laser beam onto the photoreceptor. Folding is beneficial since the optical path length can remain relatively large while the physical length of the path is reduced. While reflecting the laser beam prior to sweeping is relatively straightforward, sweeping after folding becomes more difficult since the resulting scan line must have a direction substantially perpendicular to the motion of the photoconductive surface. Consequently, prior art systems locate the motor polygon assembly and output optics such that the folding mirrors located after the output optics are substantially parallel with the scan line. While this has the benefit of simplicity, it may not be optimal.

SUMMARY OF THE INVENTION

The principles of the present invention provide for relatively compact raster scanner assemblies and compact systems which use such assemblies. A raster output scanner assembly according to the present invention is comprised of a laser source for generating laser light; a photoreceptor moving in a process direction; a rotating polygon having at least one reflecting surface for receiving the laser light and for sweeping the laser light in a sweep plane; and an F-θ scan lens positioned in the sweep plane for receiving the swept laser light and for focusing the received laser light onto the photoreceptor. A raster output scanner assembly according to the present invention further includes a first folding mirror optically positioned between the F-θ scan lens and the photoreceptor and which is aligned along a first axis, the first folding mirror for reflecting laser light passing through the F-θ scan lens, and at least a second folding mirror positioned between the first folding mirror and the photoreceptor and which is aligned along an axis which is substantially perpendicular to the process direction, the second folding mirror for receiving laser light reflected by the first folding mirror and for directing that laser light onto the photoreceptor, wherein the first axis forms an angle with the second axis.

BRIEF DESCRIPTION OF THE DRAWINGS

Various aspects of the present invention will become apparent as the following description proceeds and upon reference to the drawings, in which.

In the drawings, like numbers designate like elements. Additionally, the text includes directional signals which are taken relative to the drawings (such as right, left, top, and bottom). Those directional signals are meant to aid the understanding of the present invention, not to limit it.

DETAILED DESCRIPTION OF THE PREFERRED EMBODIMENTS

Figure 1:
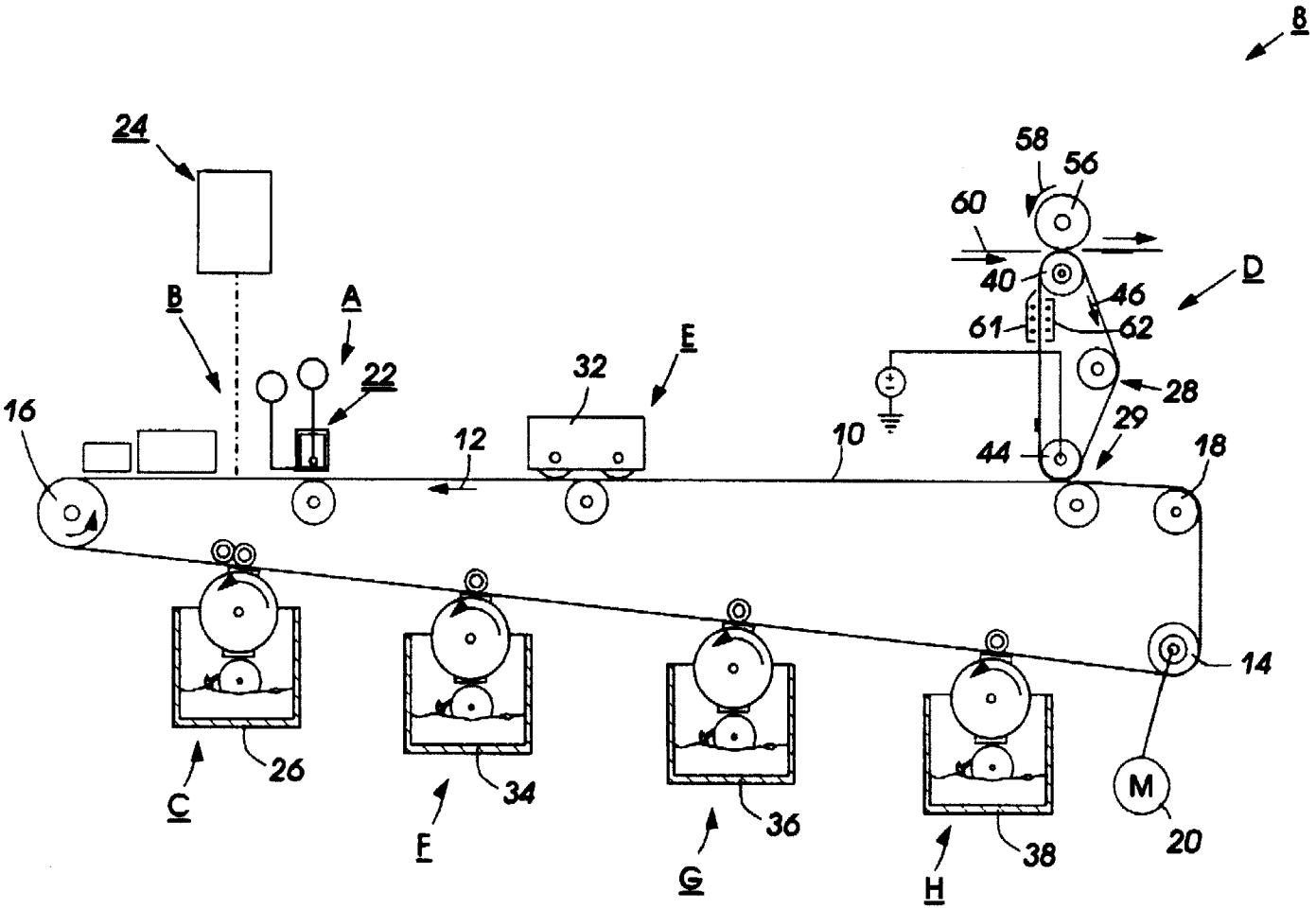
FIG. 1 schematically illustrates an electrophotographic priming machine which incorporates the principles of the present invention.

FIG. 1 illustrates an electrophotographic printing machine 8 that produces an original document. Although the principles of the present invention are well suited for use in such machines, they are also well suited for use in other devices. Therefore it should be understood that the present invention is not limited to the particular embodiment illustrated in FIG. 1 or to the particular application shown therein.

The printing machine 8 includes a charge retentive device in the form of an Active Matrix (AMAT) photoreceptor 10 which has a photoconductive surface and which travels in the direction indicated by the arrow 12. Photoreceptor travel is brought about by mounting the photoreceptor about a drive roller 14 and two tension rollers, the rollers 16 and 18, and then rotating the drive roller 14 via a drive motor 20.

As the photoreceptor moves each pan of it passes through each of the subsequently described processing stations. For convenience, a single section of the photoreceptor, referred to as the image area, is identified. The image area is that part of the photoreceptor which is operated on by the various stations to produce toner layers. While the photoreceptor may have numerous image areas, since each image area is processed in the same way a description of the processing of one image area suffices to explain the operation of the printing machine.

As the photoreceptor 10 moves, the image area passes through a charging station A. At charging station A a corona generating scorotron 22 charges the image area to a relatively high and substantially uniform potential, for example about −500 volts. While the image area is described as being negatively charged, it could be positively charged if the charge levels and polarities of the other relevant sections of the copier are appropriately changed. It is to be understood that power supplies are input to the scorotron 22 as required for the scorotron to perform its intended function.

Figure 2:
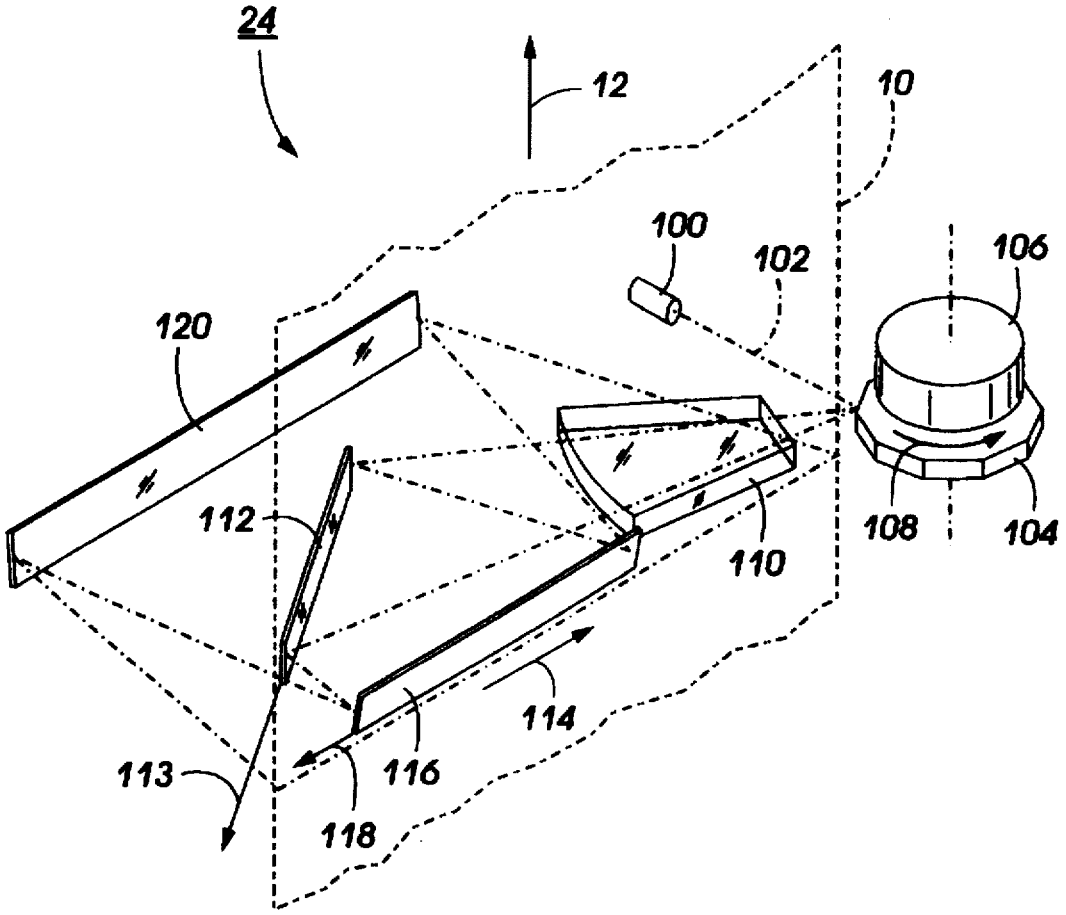
FIG. 2 schematically depicts a perspective view of the raster scanner of FIG. 1.
Figure 3:
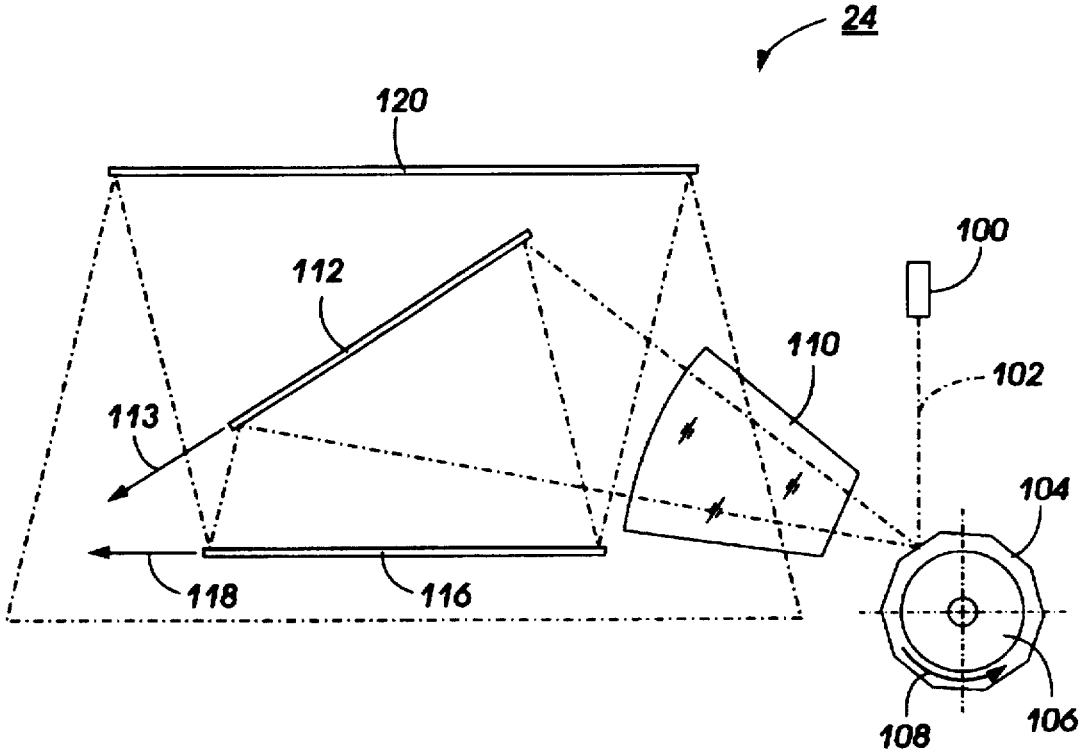
FIG. 3 schematically depicts a top down view of the raster scanner shown in FIGS. 1 and 2.

After passing through the charging station A the now charged image area passes to an exposure station B. At exposure station B the charged image area is exposed to the output of a laser based raster output scanning assembly 24 which illuminates the image area with a light representation of a first color image, say black. That light representation discharges some pans of the image area so as to create a first electrostatic latent image. As the principles of the present invention relate to the configuration of the raster output scanning assembly 24, that assembly, which is schematically depicted in more detail in FIGS. 2 and 3 is described in more detail subsequently.

After passing through the exposure station B, the now exposed image area passes through a first development station C. At the first development station C a negatively charged development material 26, which is comprised of black toner particles, is advanced to the image area. The development material is attracted to the less negative sections of the image area and repelled by the more negative sections. The result is a first toner layer on the image area.

After passing through the first development station C the image area is advanced to a transfusing module D. That transfusing module includes a positively charged transfusing member 28, which may be a belt, as illustrated in FIG. 1, or a drum which forms a first nip 29 with the photoreceptor. That nip is characterized by a first pressure between the photoreceptor 10 and the transfusing member 28. The negatively charged toner layer on the photoreceptor is attracted onto the positively charged transfusing member.

After the first toner image is transferred to the transfusing member 28 the image area passes to a cleaning station E. The cleaning station E removes any residual development material remaining on the photoreceptor 10 using a cleaning brush contained in a housing 32.

After passing through the cleaning station E the image area repeats the charge-expose-develop-transfer-clean sequence for a second color of developer material (say yellow). Charging station A recharges the image area and exposure station B illuminates the recharged image area with a light representation of a second color image (yellow) to create a second electrostatic latent image. The image area then advances to a second development station F which deposits a second negatively charged development material 34, which is comprised of yellow toner particles, onto the image area so as to create a second toner layer. The image area and its second toner layer then advances to the transfusing module D where the second toner layer is transferred onto the transfusing member 28.

The image area is again cleaned by the cleaning station E. The charge-expose-develop-transfer-clean sequence is then repeated for a third color (say magenta) of development material 36 using development station G, and then for a fourth color 38 (cyan) of development material using development station H.

The transfusing member 28 is entrained between a transfuse roller 40 and a transfer roller 44. The transfuse roller is rotated by a motor, which is not shown, such that the transfusing member rotates in the direction 46 in synchronism with the motion of the photoreceptor 10. The synchronism is such that the various toner images are registered after they are transferred onto the transfusing member 28

Still referring to FIG. 1, the transfusing module D also includes a backup roller 56 which rotates in the direction 58. The backup roller is beneficially located opposite the transfuse roller 40. The backup roller cooperates with the transfuse roller to form a second nip which acts as a transfusing zone. When a substrate 60 passes through the transfusing zone the toner layer on the compression layer is heated by a combination of heat from a radiant preheater 61 or from conductive heat from a conductive heater 62 and heat from the transfuse roller 40. The combination of heat and pressure fuses the composite toner layer onto the substrate.

As mentioned above, the raster output scanning assembly 24 is shown in more detail in FIGS. 2 and 3. The raster output scanning assembly 24 includes a laser assembly 100, beneficially comprised of a laser diode and a set of collimating optics, which outputs a laser beam 102. That laser beam is directed onto facets of a polygon 104, which is rotated by a polygon motor 106 in a direction 108. The laser beam 102 reflects from the polygon facets as they rotate so as to create a sweeping beam. That sweeping beam passes through a set of output optics 110 which focuses the sweeping beam into a spot on the photoreceptor 10 (see FIGS. 1 and 2) and which corrects for various optical errors such as wobble.

After passing through the output optics 110 the sweeping beam passes to a first folding mirror 112. That mirror is aligned along an axis 113 which is at an angle to the fast scan direction, where the fast scan direction is substantially at a right angle with the direction 12 (see FIG. 1). Essentially, the first folding mirror 112 folds the sweeping beam in the fast scan plane.

The sweeping beam reflected by the first folding mirror 112 passes to a second folding mirror 116, which is beneficially aligned along an axis 118 which is substantially parallel with the fast scan direction 114. The raster scanning assembly 24 also includes a third folding mirror 120 which reflects the sweeping beam from the second folding mirror onto the photoreceptor. The third folding mirror beneficially has an axis which is substantially parallel to the fast scan direction. It should be understood that the third folding mirror is not necessary to the principles of the present invention. Mounting the second and third folding mirrors such that they have axes parallel with the fast scan direction is beneficial since it simplifies the design and assembly of the folding mirror system.

The raster output scanning assembly 24 is implemented as a relatively compact raster scanning assembly. By setting the axis 113 of the mirror 112 at an angle with the fast scan direction the sweeping beam is folded in the fast scan plane. This allows the polygon 104 to be placed off to the side of the imaged area so as to form a compact "sidewinder" raster scanning polygon assembly. Such a sidewinder raster scanning assembly enables the electrophotographic printing machine 8 to have a relatively small footprint.

It is to be understood that while the figures and the above description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims.

What is claimed:

1. A raster output scanner assembly for sweeping a spot on a photoreceptor in a fast scan direction, the raster output scanner assembly comprising:

a laser for generating laser light;

a photoreceptor moving in a process direction which is substantially perpendicular to the fast scan direction;

a rotating polygon having at least one facet for receiving the laser light and for sweeping the laser light in a sweep plane;

an F-θ scan lens positioned in the sweep plane for receiving the swept laser light and for focusing the received laser light onto said photoreceptor; and a first folding mirror positioned between said F-θ scan lens and said photoreceptor and aligned along a first axis which is at a first angle with the fast scan direction, said first folding mirror for reflecting laser light passing through said F-θ scan lens toward said photoreceptor along a first sweep path.

2. The raster output scanner assembly according to claim 1, further including a second folding mirror positioned between said first folding mirror and said photoreceptor and aligned along a second axis, said second folding mirror for receiving laser light reflected by the first folding mirror and for reflecting that laser light toward the photoreceptor.

3. The raster output scanner assembly according to claim 2, wherein said second axis is substantially perpendicular to the process direction.

4. The raster output scanner assembly according to claim 2, further including a third folding mirror positioned between said second folding mirror and said photoreceptor and aligned along a third axis, said third folding mirror for receiving laser light reflected by the second folding mirror and for reflecting that laser light toward the photoreceptor.

5. The raster output scanner assembly according to claim 4, wherein said third axis is substantially perpendicular to the process direction.

6. A marking machine comprised of:

a photoreceptor having a photoconductive surface which moves in a process direction;

a charging station for charging said photoconductive surface to a predetermined potential;

a raster scanner assembly for exposing said photoconductive surface to produce a first electrostatic latent images on said photoconductive surface by sweeping a modulated laser beam across said photoreceptor in a fast scan direction which is substantially perpendicular to said process direction;

a first developing station for depositing developing material on said first electrostatic latent image so as to produce a first toner image on said photoconductive surface;

a transfer station for receiving said first toner image from said photoconductive surface and for transferring said first toner image onto a substrate;

wherein said raster scanner assembly includes:

a laser for generating laser light;

a rotating polygon having at least one facet for receiving the laser light and for sweeping the laser light in a sweep plane;

an F-θ scan lens positioned in the sweep plane for receiving the swept laser light and for focusing the received laser light onto said photoreceptor; and a first folding mirror positioned between said F-θ scan lens and said photoreceptor and aligned along a first axis which is at a first angle with said fast scan direction, said first folding mirror for reflecting laser light passing through said F-θ scan lens toward said photoreceptor along a first sweep path.

7. The marking machine according to claim 6, further including a second folding mirror positioned between said first folding mirror and said photoreceptor and aligned along a second axis, said second folding mirror for receiving laser light reflected by the first folding mirror and for reflecting that laser light toward the photoreceptor.

8. The marking machine according to claim 7, wherein said second axis is substantially perpendicular to the process direction.

9. The marking machine according to claim 7, further including a third folding mirror positioned between said second folding mirror and said photoreceptor and aligned along a third axis, said third folding mirror for receiving laser light reflected by the second folding mirror and for reflecting that laser light toward the photoreceptor.

10. The marking machine according to claim 9, wherein said third axis is substantially perpendicular to the process direction.

* * * * *